United States Patent [19]

Phelan et al.

[11] 4,305,368

[45] Dec. 15, 1981

[54] APPARATUS FOR VENTING FUEL VAPORS

[75] Inventors: Michael B. Phelan; Larry J. Tipton, both of Florissant, Mo.

[73] Assignee: ACF Industries, Inc., New York, N.Y.

[21] Appl. No.: 41,280

[22] Filed: May 21, 1979

Related U.S. Application Data

[63] Continuation of Ser. No. 832,527, Sep. 12, 1977, abandoned.

[51] Int. Cl.[3] ..... F02M 5/08; F02M 69/00

[52] U.S. Cl. ..... 123/516; 261/34 A; 261/DIG. 67; 261/72 R

[58] Field of Search ..... 123/516; 261/34 A, DIG. 67, 261/72 R

[56] References Cited

U.S. PATENT DOCUMENTS

| | | | |
|---|---|---|---|
| 3,368,326 | 2/1968 | Hervert | 123/516 |
| 3,374,777 | 3/1968 | Walker | 123/516 |
| 3,675,634 | 7/1972 | Tatsutoni et al. | 123/516 |
| 3,882,204 | 5/1975 | St. Amand | 261/34 A |
| 3,904,712 | 9/1975 | Taylor | 261/34 A |
| 4,058,100 | 11/1977 | Tanaka et al. | 123/516 |
| 4,062,910 | 12/1977 | Rogerson et al. | 261/34 A |

*Primary Examiner*—R. A. Nelli

*Attorney, Agent, or Firm*—J. Joseph Muller

[57] ABSTRACT

Apparatus for venting fuel vapors present in the fuel bowl of a carburetor for an internal combustion engine. A carburetor has at least one air passage through which air is drawn into the engine, a throttle valve positioned in the air passage and movable between an open and a closed position to control the flow of air therethrough, a fuel circuit by which fuel is delivered from the fuel bowl to the air passage for mixing with air passing therethrough, and means responsive to the movement of the throttle valve for controlling the quantity of fuel delivered through the fuel circuit. A fuel bowl cover has a vent through which fuel vapors discharge when the vent is open and a valve opens and closes the vent. A fuel pump supplies fuel from the fuel bowl to the air passage as the throttle valve opens and moves the valve to a vent opening position in response to the movement of the throttle valve. The pump is actuated as the throttle valve opens whereby the valve is opened and vapors in the fuel bowl are vented.

2 Claims, 4 Drawing Figures

APPARATUS FOR VENTING FUEL VAPORS

This is a continuation of application Ser. No. 832,527, now abandoned filed Sept. 12, 1977.

BACKGROUND OF THE INVENTION

This invention relates to carburetors and more particularly to apparatus for venting fuel vapors from the fuel bowl of a carburetor.

Carburetor assemblies typically include a fuel bowl which holds fuel, e. g. gasoline, that is supplied to the engine on which the carburetor is installed. The gasoline gives off vapors some of which are heavier and some of which are lighter than air. The presence of these vapors in the fuel bowl creates an internal bowl pressure which may force fuel out of the fuel bowl and into the air passage where the air/fuel mixture combusted in the engine is produced thereby making precise fuel metering difficult and causing an overly rich air/fuel mixture to be produced. Conventionally, the heavier than air vapors are drawn off from the fuel bowl to, for example, a charcoal canister where they condense. The lighter than air vapors, meanwhile, are vented from the fuel bowl to an air cleaner mounted adjacent the carburetor or to the space between the air cleaner and the carburetor's air inlet. By venting the fuel vapors from the fuel bowl, the pressure in the fuel bowl is balanced with the outside air pressure and fuel metering is precisely maintained. However, the venting of the lighter than air vapors is usually continuous and, when the engine is off, the vapors eventually saturate the air cleaner or the space between the cleaner and the air inlet. Further, these vapors gravitate into the carburetor's air horn and the intake manifold of the engine and may displace the air in these regions. Consequently, when the engine is next started, an overly rich air/fuel mixture is supplied to the engine which not only makes the engine difficult to start, but also increases the amount of pollutants emitted from the engine during starting.

SUMMARY OF THE INVENTION

Among the several objects of the present invention may be noted the provision of apparatus for venting fuel vapors present in the fuel bowl of a carburetor and, in particular, lighter than air fuel vapors; the provision of such apparatus for venting these vapors to maintain precise fuel metering from the fuel bowl; the provision of such apparatus for not venting such vapors when said engine is off thereby to enhance the starting of the engine and reduce emissions during starting; the provision of such apparatus for venting fuel vapors to an air cleaner mounted adjacent the carburetor; and the provision of such apparatus which is simple in design, low in cost and easy to install.

Briefly, apparatus of the present invention is for venting fuel vapors present in the fuel bowl of a carburetor for an internal combustion engine, the carburetor having at least one air passage through which air is drawn into the engine, a throttle valve positioned in the air passage and movable between an open and a closed position to control the flow of air therethrough, a fuel circuit by which fuel is delivered from the fuel bowl to the air passage for mixing with air passing therethrough, and means responsive to the movement of the throttle valve for controlling the quantity of fuel delivered through the fuel circuit. The apparatus comprises a fuel bowl cover having a vent through which fuel vapors discharge when the vent is open and a valve for opening and closing the vent. A fuel pump supplies fuel from the fuel bowl to the air passage as the throttle valve opens, and the pump includes means for moving the valve to a vent opening position. Means responsive to the movement of the throttle valve actuates the pump as the throttle valve opens whereby the valve is opened and vapors in the fuel bowl are vented. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
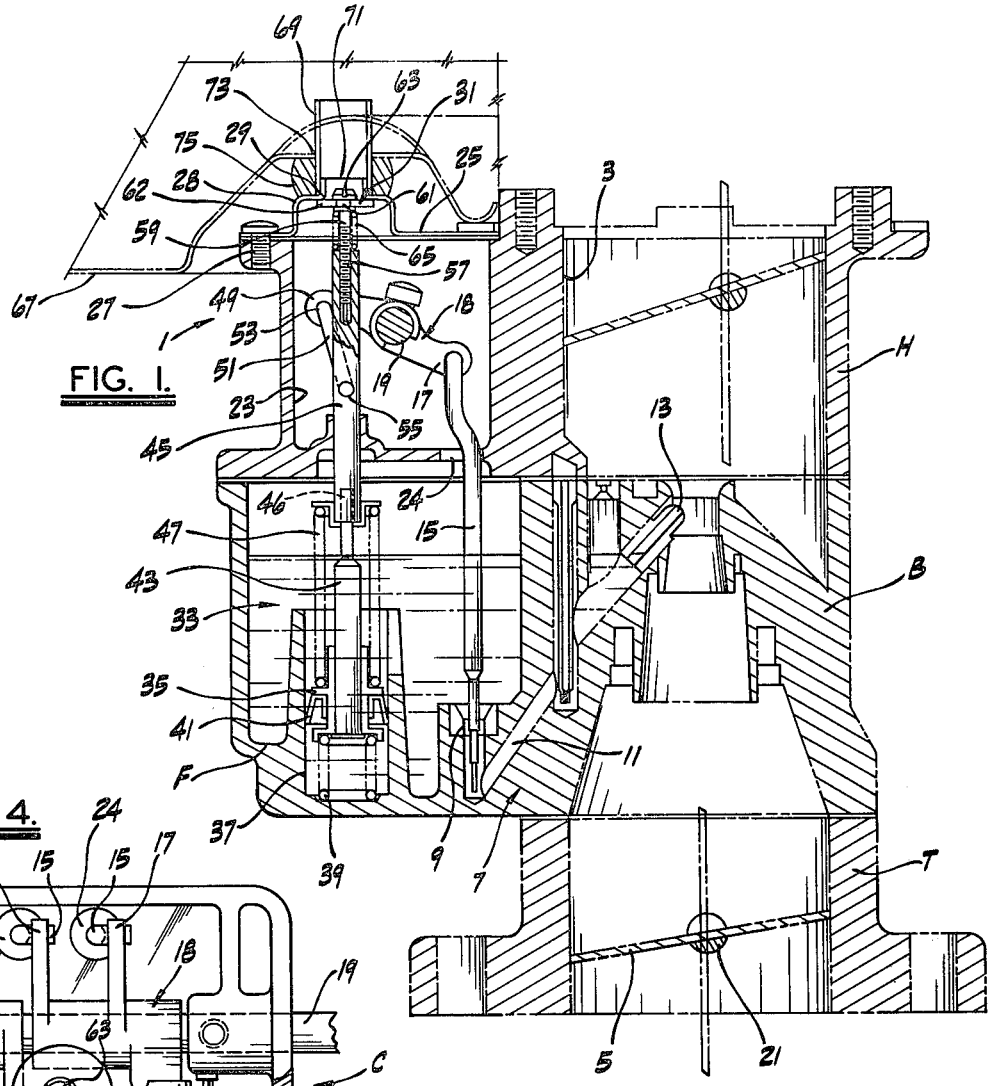
FIG. 1 is a side elevational view of a carburetor, in section, showing apparatus of the present invention for venting fuel vapors from a fuel bowl of the carburetor, a vent of the apparatus being shown closed.

Referring now to the drawings, apparatus of the present invention for venting fuel vapors present in the fuel bowl of a carburetor C for an internal combustion engine (not shown) is indicated generally at 1. As shown in FIG. 1, carburetor C comprises an air horn H, a main body B and a throttle flange T. An air passage 3, through which air is drawn into the engine, is formed in the air horn and a throttle valve 5 is positioned in the throttle flange, at the lower or outlet end of the passage, and is movable between an open position and a closed position to control the flow of air through the air passage.

A fuel circuit, generally indicated 7 is formed in main body B for delivery of fuel from a fuel bowl F, also formed in the main body, to an air passage 3 for mixing with air passing therethrough. Fuel circuit 7 includes an orifice, 9, which is in the lower part of fuel bowl F, a fuel passage 11 through which fuel flowing out of the orifice is drawn and a nozzle 13 through which fuel is drawn into air passage 3 and mixed with air to form an air/fuel mixture combusted in the engine.

Figure 4:
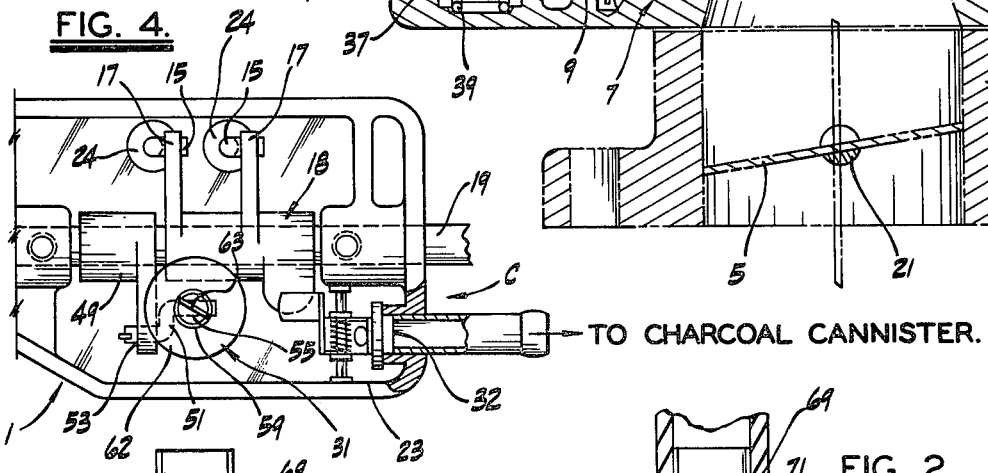
FIG. 4 is a top plan view of apparatus of the present invention.

A metering rod 15 is suspended from the hangar portion 17 of a rod lifter cam 18 so the lower end of the rod is positioned in orifice 9. Cam 18 is carried by a rotatable shaft 19 whose rotational movement is tied to that of throttle valve 5 by a linkage (not shown) which connects shaft 19 to a shaft 21 on which the throttle valve is mounted. Shaft 19 is conventionally referred to as a "counter" shaft and the construction of the linkage by which its movement is tied to that of throttle valve 5 is well known in the art. The lower end of metering rod 15 is stepped in diameter so that as the metering rod is raised or lowered (as throttle valve 5 is more fully opened or closed) a smaller or larger diameter step of the rod is positioned in orifice 9. This permits more or less fuel to flow from fuel bowl F to air passage 3 through fuel circuit 7. Thus the metering rod comprises means responsive to the movement of the throttle valve for controlling the quantity of fuel delivered through the fuel circuit. If carburetor C has more than one air passage 3, a separate fuel circuit 7 may be provided for each. In this instance, a separate metering rod 15 is provided for each fuel circuit and, as shown in FIG. 4, each metering rod is suspended from a hangar 17. Both hangars form part of rod lifter cam 18, which again is carried by counter shaft 19 so both metering rods are moved in unison as the shaft rotates in response to the movement of throttle valve 5.

Fuel in fuel bowl F forms vapors which rise from the fuel bowl and enter a chamber 23 formed in air horn H above the fuel bowl. Some of these fuel vapors are heavier and some are lighter than air. Chamber 23 has an opening 24 in its bottom through which metering rod 15 is suspended and fuel vapors enter chamber 23 by rising upwardly through this opening. A fuel bowl cover 25 fits over chamber 23 and is secured to the carburetor by, for example, bolts such as bolt 27. The cover has a raised dome portion 28, in which a vent 29 is formed and the lighter than air fuel vapors discharge through the vent when it is open. A valve 31 opens and closes vent 29 as will be described hereinafter. The heavier than air fuel vapors are drawn off from the fuel bowl through a vent 32 in the side of chamber 23 to, for example, a charcoal canister (not shown) where they condense. The charcoal canister is on a level below that of vent 32 and a downwardly directed nipple N connects to a tube (not shown) leading to the canister and the heavier than air vapors flow by gravity to the canister. When vent 29 is closed, the lighter than air fuel vapors may also be drawn off to the canister.

A fuel pump, generally indicated 33, supplies fuel from fuel bowl F to air passage 3 as throttle valve 5 opens. Pump 33 is commonly referred to as an "accelerator" pump and its function is to force feed fuel from the fuel bowl to the air passage during accelerations of the engine. The pump is comprised of a piston 35 and a cylinder 37, the cylinder being fixed and the piston movable or slidable in the cylinder. As shown in FIG. 1, cylinder 37 is formed as part of fuel bowl F and a rate spring 39 is seated in the cylinder to act against the piston and control the rate of discharge of fuel from the pump. A plunger cup 41, made of rubber or other suitable resin material, fits onto main body 43 of piston 33 and creates a chamber into which fuel is drawn from the fuel bowl during the intake portion of a pump cycle and out of which fuel is discharged during the discharge portion of a pump cycle. Pump 33 further includes a pump stem 45 connected to piston 35. Pump stem 45 has an axial bore 46 in its lower end for receiving the upper end of piston 33 when the piston completes its downward or discharge stroke. An over travel spring 47 is seated against the piston and the pump stem and is compressed by a continued movement of the pump stem after the piston completes its downward stroke.

Pump stem 45 is also connected to counter shaft 19 via a pump lever 49, which is carried by counter shaft 19 and moves therewith, and a S-link 51. One end of the S-link fits in a bore 53 in lever 49 and the other end of the link fits in a lateral bore 55 in stem 45. When counter shaft 19 rotates in response to the opening of throttle valve 5 (this rotation being counterclockwise) pump lever 49 rotates counterclockwise and this movement is transmitted, via S-link 51, as a downward force on pump stem 45 to move piston 35 into cylinder 37 and discharge fuel from pump 33.

Figure 3:
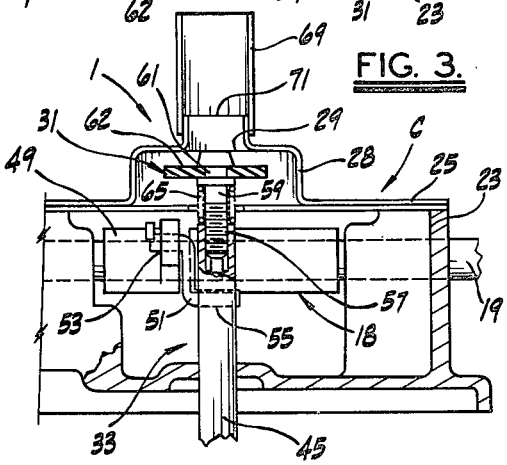
FIGS. 2 and 3 are respective side and rear elevational views of the carburetor, in section, showing the apparatus of the present invention with the vent open.
Figure 2:
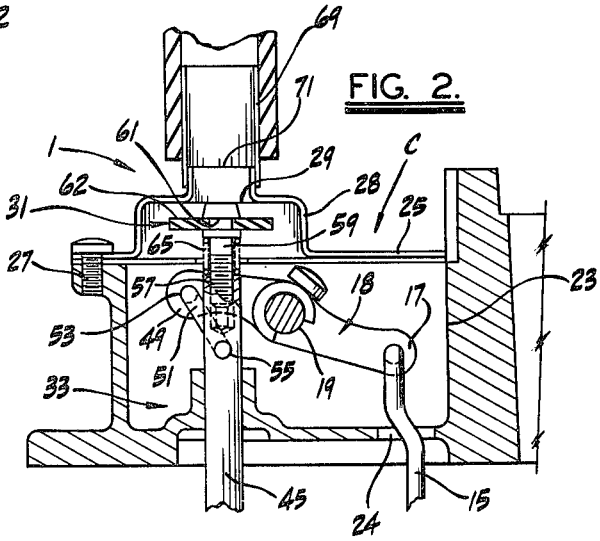

Pump stem 45 is axially aligned with vent 29 and has an axial threaded bore 57 in its upper end. A screw 59 is received in bore 57. Screw 59 has a reduced diameter or necked-down section 61 and valve 31, which comprises a washer 62 is mounted on the screw about the necked-down section thereof. The position of screw 59 in bore 57 is adjustable and the screw has a slot 63 in its upper face for adjusting its position with a screwdriver or a similar tool. This adjustment is made when throttle valve 5 is closed at which position pump stem 45 is raised to its highest position (see FIG. 1). Washer 62 is of larger diameter than vent 29, and when screw 59 is properly adjusted, the washer seats against the underside of fuel bowl cover 25 and closes the vent. Thereafter, when throttle valve 5 opens, pump 33 is actuated by the movement of counter shaft 19, lever 49 and link 51 and stem 45 is urged downwardly, as shown in FIGS. 2 and 3. Washer 62 then moves away from vent 29 to open the vent. Thus, pump stem 45 comprises means included in pump 33 for moving valve 31 to a vent opening position and vent 29 is closed only when throttle valve 5 is substantially closed and is open at all other throttle valve positions. A spring 65 is inserted over the shank of screw 59 and seats against the upper end of stem 45 to prevent rotation of the screw and maintain its adjustment.

In operation, during assembly of carburetor C, screw 59 with washer 62 attached is threaded into bore 57 of pump stem 45 and adjusted until washer 62 seats against the underside of fuel bowl cover 25 to seal or close vent 29. This, as noted is done when stem 45 is at its uppermost position corresponding to the closed position of throttle valve 5. Proper closure of valve 31 may be checked, for example, by flowing air or other appropriate fluid through the vent and adjusting the position of screw 59 until fluid flow stops. Thereafter, when throttle valve 5 is closed, as when the engine with which carburetor C is used is shut off, vent 29 is closed and fuel vapors in fuel bowl F or in chamber 23 cannot escape into an air cleaner installed over the carburetor or the space surrounding the inlet to air passage 3 and thus cannot be sucked into the engine when it is started. Only after the engine is started when throttle valve 5 is opened, is vent 29 opened. This results from the counterclockwise rotation of counter shaft 19 which produces a downward movement of pump stem 45, the downward movement of the pump stem actuating pump 33. Washer 62 moves down and away from vent 29 and the vent is open. Thereafter, as long as throttle valve 5 remains open, vent 29 is open for discharge of fuel vapors therethrough. The venting of the fuel bowl vapors through vent 29 keeps the internal fuel bowl pressure balanced with the outside atmospheric pressure to maintain precise fuel metering from the fuel bowl through the fuel circuit.

An air cleaner 67 is positioned adjacent carburetor C, i.e. over the carburetor, as shown in FIG. 1, and a vent tube 69 fits over vent 29 and extends into the air cleaner. A lip 71 is formed about vent 29 and vent tube 69 fits over the lip and is attached to fuel bowl cover 25, as, for example, by brazing. A suitable corresponding opening 73 is formed in air cleaner 67 for vent tube 69 to extend into the air cleaner. A closed cell foam material 75 is placed around the vent tube to prevent leakage of fuel vapors into the space between the carburetor and the air cleaner. Fuel vapors discharging from fuel bowl F through vent 29 are thus directed into air cleaner 67.

In view of the above, it will be seen that the several objects of the invention are achieved and other advantageous results obtained.

As various changes could be made in the above construction without departing from the scope of the invention, it is intended that all matter contained in the above description or shown in the accompanying drawings shall be interpreted as illustrative and not in a limiting sense.

We claim:

1. Apparatus for venting fuel vapors present in the fuel bowl of a carburetor for an internal combustion engine, said carburetor having at least one air passage through which air is drawn into the engine, a throttle valve positioned in said air passage and movable between an open and a closed position to control the flow of air therethrough, a fuel circuit by which fuel is delivered from said fuel bowl to said air passage for mixing with air passing therethrough, and fuel metering rod responsive to the movement of the throttle valve for controlling the quantity of fuel delivered through said fuel circuit, the apparatus comprising:

a fuel bowl cover having a vent through which fuel vapors discharge when the vent is open;

a fuel pump comprising a piston movable in a cylinder for supplying fuel from said fuel bowl to said air passage as said throttle valve opens, the fuel pump including a stem connected to the piston, said stem being substantially axially aligned with said vent and having an axial bore therein;

a valve for opening and closing the vent, said valve comprising a washer mounted on a screw which is received in said axial bore, the position of said screw in said bore being adjustable thereby to seat said washer against said cover and close said vent; and, means responsive to the movement of said throttle valve for actuating said pump as said throttle valve opens whereby said valve is open and vapors in said fuel bowl are vented, said pump actuating means comprising a shaft adapted for rotational movement by said throttle valve as it opens and closes, an S-link connecting said shaft to said stem to move said stem to a position in which said valve carried thereby seats against said fuel bowl cover when said throttle valve is substantially closed thereby to close said vent and to move said stem and said valve away from said cover as said throttle valve opens thereby to open said vent, the position of said shaft when said throttle valve is at other than its substantially closed position being sufficient to maintain said stem and said valve in a vent opening position whereby said vent is closed only when said throttle valve is substantially closed and is open at all other throttle valve positions.

2. Apparatus as set forth in claim 1 wherein an air cleaner is positioned adjacent said carburetor and a vent tube is fitted over said vent and extends into said air cleaner whereby fuel vapors discharging from said fuel bowl are directed into said air cleaner.

* * * * *